United States Patent [19]

Pettersson et al.

[11] 3,946,674

[45] Mar. 30, 1976

[54] CARRYING PART FORMING A PROJECTILE

[75] Inventors: Henry Gustaf Erland Pettersson; Lars-Erik Skagerlund; Rolf Lennart Stålfors, all of Karlskoga, Sweden

[73] Assignee: AB Bofors, Bofors, Sweden

[22] Filed: July 10, 1974

[21] Appl. No.: 487,101

[30] Foreign Application Priority Data

Aug. 3, 1973 Sweden ..... 7310679

[52] U.S. Cl. ..... 102/70.2 P; 102/70.2 G; 136/205

[51] Int. Cl.[2] ..... F42C 13/02; H01L 35/00

[58] Field of Search ..... 102/70.2 P, 70.2 G, 70.2 R; 136/205

[56] References Cited

UNITED STATES PATENTS

| | | | |
|---|---|---|---|
| 2,137,598 | 11/1938 | Vos | 102/70.2 P |
| 2,255,245 | 9/1941 | Ferrel | 102/70.2 P |
| 2,998,771 | 9/1961 | Mosier | 102/70.2 P |
| 3,088,988 | 5/1963 | Menke | 136/205 |
| 3,323,459 | 6/1967 | Buffet | 102/70.2 G |
| 3,483,821 | 12/1969 | Brothers | 102/70.2 R |
| 3,786,757 | 1/1974 | Goldstein et al. | 102/70.2 P |
| 3,793,958 | 2/1974 | Holt et al. | 102/70.2 P |

*Primary Examiner*—Charles T. Jordan
*Attorney, Agent, or Firm*—Elliott I. Pollock

[57] ABSTRACT

A projectile comprises an elongated casing containing a payload, a proximity fuze, a transmitter unit operative to transmit a beam of radiation toward a target, and a receiver unit responsive to radiation reflected from the target for controlling the proximity fuze to selectively initiate operation of the payload at a predetermined distance from the target. The transmitter unit is located adjacent the tail end of the projectile rearward of the payload and comprises a pyrotechnical charge positioned at the extreme rear of the projectile and operative, when ignited, to cause emission of light via a lens in an opening in the side of the projectile to form the transmitted beam of radiation. The receiver unit is located adjacent the nose end of the projectile forward of the payload to maximize the measuring base between the transmitted and received beams of radiation, and comprises an optical system associated with an interference filter, radiation detector, and electronic control circuit.

15 Claims, 2 Drawing Figures

CARRYING PART FORMING A PROJECTILE

The present invention relates to a carrying part forming a projectile, shell etc which for the initiation of a payload if provided with a proximity fuze operating with a transmitter beam from a transmitter unit and a receiver beam for a receiver unit, crossing the transmitter beam.

For ammunition of this kind, in order to achieve a maximum effect, it is essential that the projectile etc is initiated at a well-defined, pre-set distance from the target in question. Thus, for instance, it is of importance that deviations occurring in the manufacture of the elements in the projectiles that determine the initiating distances are not allowed to increase the dispersion of these.

The purpose of the present invention is primarily to solve said problems, but also gives indications of further developments which make it possible to use special components in e.g. the transmitter unit. Due to the sharply defined receiver beam, the anti-jamming properties are also increased compared with existing microwave proximity fuzes.

The feature that can mainly be considered to be characteristic for a carrying part according to the present invention is that it carries the receiver unit in its front section and the transmitter unit in its rear section.

Figure 1:
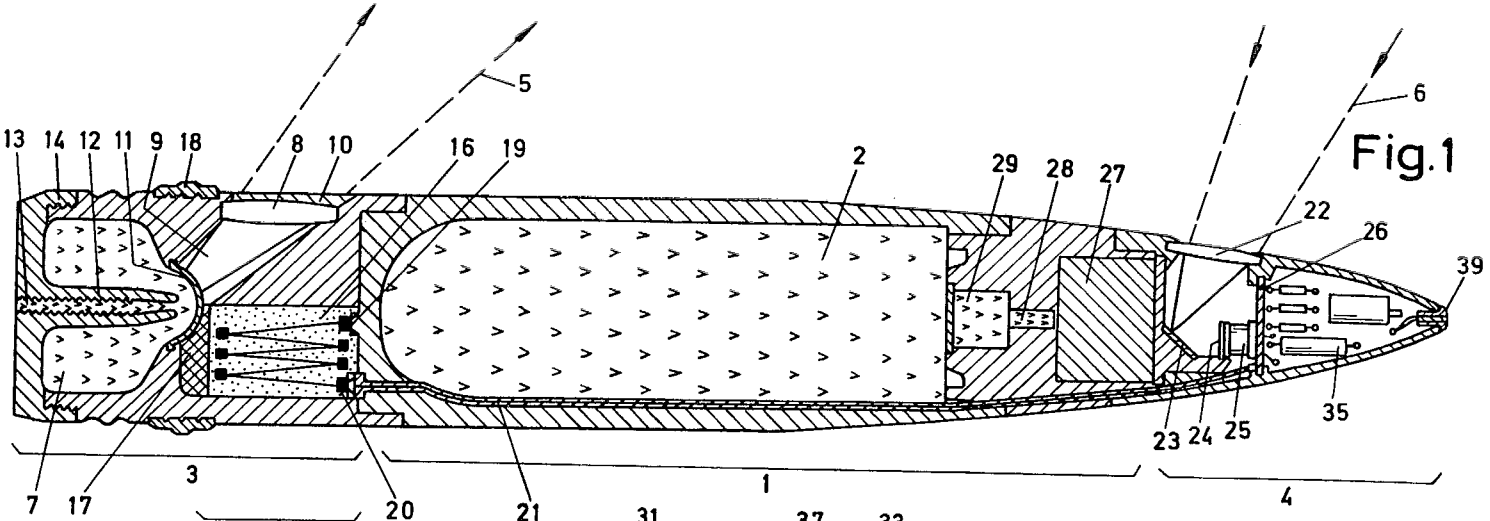

An embodiment now proposed which has the characteristics significant for the invention will be described in the following, with reference to the attached drawing, in which FIG. 1 shows a projectile, in cross-section, and FIG. 2 in the form of a diagram shows the wiring for the electronics utilized for the projectile according to FIG. 1.

FIG. 1 shows a carrying part in the form of a projectile comprising an effect part 1, the payload of which, in the form of a bursting charge, is designated 2. The projectile is provided with a proximity fuze comprising a transmitter unit 3, which is placed in the rear section of the projectile and a receiver unit 4 which is placed in the front section of the projectile. The proximity fuze works with a transmitter beam 5 from the transmitter unit and a receiver beam 6 for the receiver unit. Said beams cross each other so that a target, not shown, will reflect the light or radiation emitted from the transmitter unit to the receiver unit when it is in a certain position in relation to the projectile, and the light or radiation which is reflected is then employed to actuate electronic equipment associated with the proximity fuze for initiation of the charge 2.

For a 40 mm projectile with a muzzle velocity of approximately 1,000 m/s and a rate of spin of approximately 1,000 r.p.s. it can be appropriate to have the transmitter beam 5 symmetrical and with a beam angle of 6°×6° while the receiver beam 6 is made unsymmetrical with a beam angle of 24° × 6°, of which 6° is measured transversally across the axis of rotation of the projectile. If a 10 m range of the proximity fuze is then desired, the axis of symmetry of the transmitter beam emitted is given an inclination to an angle of approximately 44°, while the corresponding angle of inclination for the receiver beam will be approximately 53.4°. It may then be mentioned that the direction of the receiver beam is chosen with consideration taken both to approaching and departing targets. The aperture chosen for the transmitter and receiver optics should appropriately be approximately 2 $cm^2$.

In order to achieve the radiation comprising beam 5 from the transmitter unit, a pyrotechnical charge 7 is utilized, which is located farthest to the rear in the rear section of the projectile. The pyrotechnical charge 7 is connected with an opening in the side wall of the projectile, in which a lens 8 is fitted. The opening and the charge are connected with each other via a channel 9, which extends from the axis of rotation of the projectile forwards/outwards. Said lens 8 has been given an ellipsoidal form, so that it can transform the light emanating from the pyrotechnical charge of obliquely towards the lens into a beam of light emitted symmetrically from the lens and forming the transmitter beam 5. The lens 8 can, for this purpose, be mounted in the opening so that it will be essentially parallel to the axis of rotation of the projectile, or so that is substantially conforms to the envelope surface of the projectile at the section in question of the projectile. From the point of view of function, said ellipsoidal lens 8 can be compared with a symmetrical lens placed at right angles to the optical axis. The lens should appropriately be made of silicon, quartz or the like.

For protection, the lens 8 is covered with a protective cover 10 made of plastic or the like, which can be separated from the projectile body by the centrifugal forces that arise when the projectile is fired. Said protective cover is thrown to the side and is shattered when the projectile leaves the bore of the gun barrel employed to fire the projectile.

The space for the pyrotechnical charge 7 is limited by a membrane 11 which after approximately 0.5 s (corresponding to an arming distance of approximately 500 m) is heated up by the pyrotechnical charge 7, which membrane will then serve as a source of radiation. The membrane 11 is made of a material which is known in itself, e.g. tungsten carbide. The membrane has a hemispherical form, in order to be able to resist mechanically the high acceleration stresses in question, in this case (40,000 - 50,000 g).

An alternative to the indirect emission of light via a membrane is to utilize the pyrotechnical charge directly, i.e. instead of the membrane, an open hole is used. However, the pressure conditions must than be such that the gases from the charge are prevented from reaching the optics.

The pyrotechnical charge 7 is placed symmetrically around a rotation-symmetrical center part 12, which is made with an exhaust channel 13 for the exhaust gases from the pyrotechnical charge. The center part 12 and the exhaust channel 13 extend in towards the membrane 11, to form passages serving as constrictions for the exhaust gases. As the gases in this way are forced toward the membrane 11, maximum heating of the membrane is achieved. The position of the pyrotechnical charge 7 also has the result that at an axial combustion of the charge, residue and particles are thrown out against the wall of the space containing the charge by the centrifugal forces in the projectile, so that clean burning is obtained during the whole of the time in connection with the membrane. Obtaining axial combustion in pyrotechnical charges of this kind is known in itself.

Said exhaust channel 13 emerges centrally in the bottom plate 14 of the projectile, which has the result that it counteracts the formation of vacuum that occurs with projectiles of this kind, thereby improving the properties of the projectile in the trajectory.

The exhaust channel 13 is also made with internal, fine threads, and is pressed full of powder. The double function is thereby obtained of keeping the exhaust channel well sealed in the tube during the firing, so that the transmitter unit 3 is not blown apart, and also that a delay in starting up the transmitter unit is achieved, thereby to delay the generating of electricity by thermoelectric elements 16 until the projectile has had time to leave the gun barrel. Said powder pressed into the exhaust channel serves as a pyrotechnical delayed-action device, which is ignited by the temperature in the barrel.

The projectile is provided with a part 15 for separating the pyrotechnical charge 7 from the bursting charge 2. In addition to defining said channel 9, the separating part 15 also defines a space containing a number of thermo-electric elements 16.

The thermo-electric elements 16 are of a kind which is known in itself, and are made with so-called hot and cold soldering points, and through the installation in the projectile, natural positioning of said elements is obtained. The membrane 11 is connected with the space for the thermo-electric elements 16 via a wall 17 of heat-diffusing material (e.g. copper). The cold soldering points are directed towards the bursting charge 2 which by means of the function of preventing heat propagation of the separating part can be kept at the low temperature necessary, in spite of the presence of the pyrotechnical composition. The thermo elements 16 are connected in series, and in the present case it has been elected to use approximately 100 of them. For insulation and strength-technical reasons, the elements are embedded in a ceramic member.

Through the embodiment shown of the separating part and the space for the pyrotechnical charge, a mechanically strong section of the projectile is obtained, which is suitable for canneluring of a cartridge case not shown.

In FIG. 1, the black squares symbolize soldering points, and the cathode 19 of the generator is connected to the projectile body, while its anode 20 is insulated from said body and is connected to a conductor 21 which leads to the receiver unit 4. The transmitter 3 is made in the form of a separate unit that can be fastened to the effect part 1. The fastening itself is not shown in the figure, but can be made in a way which is known in itself.

Viewed from outside, the receiver unit 4 consists of an optical lens 22, a flat mirror 23 set at an angle, an interference filter 24 and a detector 25, as well as the relevant electronic equipment as indicated in the following. In this case, the optics are not subjected to as high a temperature as on the transmitter side, and it is therefore possible to use some cheaper material, although it must be sufficiently hard so that is not eroded by e.g. drops of water in the air.

The receiver lens 22 also has an ellipsoidal form, but in this case the optical axis is arranged more at right angles to the lens, and the field of view sensed by the optics will therefore be flattened, compared with the case of the lens 8. Through the form of the lens 22, better conformity with the envelope surface of the projectile at the tapered section of the carrying part is obtained than a symmetrical lens would give. Moreover, the greatest possible aperture is achieved with said lens 22, which is of significance or the sensitivity of the detection.

When a reflection is received from the outer limit of the range, the radiation is focused on the upper edge of the flat mirror 23. On the other hand, if the target is in front of the range limits, and in spite of this a reflection passes the lens, the beam will come above the mirror 23, and therefore a very distinct front outer range limit is obtained.

The interference filter 24 is appropriately made to let through radiation with a wave length of particularly approximately 2.8 $\mu$, where the atmospheric transmission for radiation of sunlight is very low, which contributes towards making a proximity fuze proof against jamming.

The detector 25 is of a type which is known in itself, which does not require any cooling, and which is sufficiently rapid to make said function possible. The detector is fastened to a wall 26 in front section of the projectile, and the electronic equipment is placed in front of the wall.

In order to achieve the initiation of the bursting charge 2, the projectile is provided with a conventional delayed-arming device 27, of a mechanical design, which comprises a gap igniter included in the electronic equipment. The gap igniter actuates a priming charge 28 and a bottom charge 29, for initiation of the actual bursting charge 2.

Figure 2:
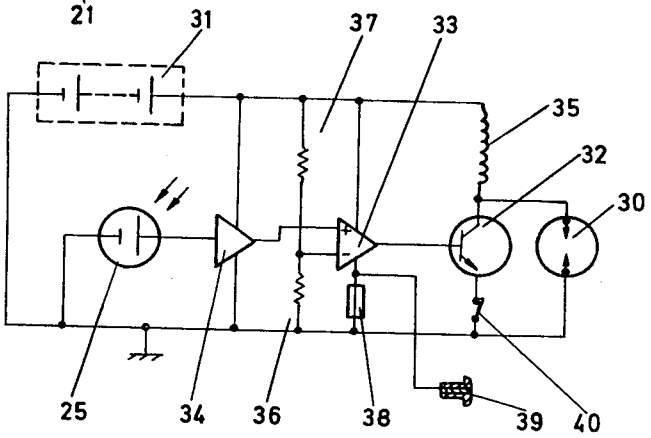

In FIG. 2, said gap igniter is designated 30, while a source of voltage containing the thermo elements has the designation 31. The electronic equipment also includes a transistor 32, an operational amplifier 33 and a further amplifier 34, which amplifies the signal obtained from the detector 25. The collector circuit of the transistor also includes an inductor 35, and two connection resistors 36 and 37 and a fuse 38 are also included in the circuit. The projectile also has an impact switch 39.

The circuit according to FIG. 2 functions in the following way. When the pyrotechnical charge 7 is ignited, after a given time a voltage is obtained from the source of voltage 31. The operational amplifier 33 is then connected to the transistor 32 in such a way that the transistor receives a certain base current, which causes the transistor to be conducting and current flows through the inductor 35. When a target reflects the transmitted radiation, an electric voltage is generated in the detector 25, which voltage is amplified in the amplifier 34, which then actuates the operational amplifier to choke the base current of the transistor. Because of the inductor 35, the gap igniter 30 then functions, and the timing charge 28 is initiated. The corresponding function is obtained if the impact switch 39 functions.

The proximity function can be paralyzed manually, by means of a voltage obtained externally from the weapon being applied via the contact 40 over the fuse 38 so that this melts, which involves that the influence of the detector and the amplifier 34 on the operational amplifier 33 is cut out, i.e. base current will flow in the base circuit of the transistor regardless of whether the detector is exposed to radiation.

An appropriate size of the inductance for 40 mm ammunition is 470 $\mu$ H at 50 mA, which involves that the inductor can be given a size corresponding to that of an ordinary miniature resistor. It can also possibly be appropriate to introduce a voltage regulator which keeps the voltage obtained from the thermo-electric element constant. The threshold function built into the above-mentioned operational amplifier, which counteracts initiation by jamming pulses, can be made in a different way, and the inductor can also be replaced by a condenser coupling of an appropriate kind.

Also the receiver unit 4 can consist of a unit that can be fastened to the effect part 1.

The invention is not limited to the embodiment shown above as an example, but can be subject to modifications, within the scope of the following claims. Thus, it is conceivable to utilize more than one transmitter beam and/or receiver beam. The most essential point in this respect is that the transmitter beam is placed at the rear and the receiver beam at the front of the projectile, so that the largest possible measuring base is obtained, which involves a large angle betweeen the outer rays in the transmitter and receiver beams. As regards the source of radiation itself, it is possible to replace the pyrotechnical charge 7 with a low-voltage lamp, which receives current from the thermo-electric elements.

We claim:

1. In a projectile of the type comprising an elongated casing containing a payload, a proximity fuze, a transmitter unit operative to transmit a beam of radiation toward a target at an angle to the longitudinal axis of said projectile, and a receiver unit responsive to a received beam of radiation reflected from the target and crossing said transmitted beam for controlling said proximity fuze to selectively initiate operation of said payload at a predetermined distance from the target, the improvement wherein said transmitter unit is located adjacent the tail end of said projectile rearward of said payload, and said receiver unit is located adjacent the nose end of said projectile forward of said payload thereby to widely separate the positions on said projectile at which said beams are transmitted by and received by said transmitter and receiver units respectively to achieve a comparatively large angle between the outer rays in the transmitted and received beams respectively and to maximize the measuring base defined between said transmitted and received beams of radiation, said transmitter unit comprising a pyrotechnical charge positioned at the extreme rear of said projectile, an opening in the side of said projectile connected via an interior channel to the space containing said charge, the space for said pyrotechnical charge being connected to said channel via a membrane which can be heated by combustion of said charge, said membrane in a heated condition serving as a source of radiation, said pyrotechnical charge, when ignited, thereby being operative to cause emission of light via said channel and opening, and a lens adjacent said opening for forming said emitted light into said transmitted beam.

2. The projectile of claim 1 wherein said membrane has a hemispherical shape.

3. The projectile of claim 1 wherein the space for said charge is located in rotational symmetry about the longitudinal axis of said projectile, the rear end of said space being defined by a bottom plate extending across the rear end of the projectile and having an elongated portion extending forwardly along the axis of said projectile through said space, said elongated portion defining an axial exhaust channel for the exhaust of gases generated by combustion of said charge which exhaust channel opens into said bottom plate at the rear end of said elongated portion, the forward end of said elongated portion being located adjacent to but spaced from said membrane to define a constricted passageway for said exhaust gases adjacent said membrane.

4. The projectile of claim 3 wherein said exhaust channel contains a delay charge that is initiated when said projectile is fired and which operates to ignite the pyrotechnical charge after a predetermined time delay.

5. The projectile of claim 1 wherein said lens is positioned essentially parallel to the longitudinal axis of said projectile, said lens having an ellipsoidal shape operative to transform obliquely received radiation from said membrane into a symmetrical transmitted beam of radiation.

6. The projectile of claim 1 wherein said transmitter unit includes a separating part positioned between said pyrotechnical charge and said payload, the separating part including an interior space containing thermoelectric elements for generating electric power.

7. The projectile of claim 6 wherein said separating part defines said interior channel extending between said pyrotechnical charge and said opening.

8. The projectile of claim 6 wherein said membrane and portions of said thermoelectric elements are spaced from one another by an intervening wall of heat-diffusing material.

9. The projectile of claim 1 wherein said transmitter unit is fastened as an integral unit to the rear end of a separate portion of said projectile containing said payload.

10. The projectile of claim 1 wherein the transmitter unit and the receiver unit are connected to each other via an electric conductor extending between the units.

11. The projectile of claim 1 wherein said receiver unit comprises an integral unit fastened to the forward end of the portion of said casing containing said payload.

12. In a projectile of the type comprising an elongated casing containing a payload, a proximity fuze, a transmitter unit operative to transmit a beam of radiation toward a target at an angle to the longitudinal axis of said projectile, and a receiver unit responsive to a received beam of radiation reflected from the target and crossing said transmitted beam for controlling said proximity fuze to selectively initiate operation of said payload at a predetermined distance from the target, the improvement wherein said transmitter unit is located adjacent the tail end of said projectile rearward of said payload, and said receiver unit is located adjacent the nose end of said projectile forward of said payload thereby to widely separate the positions on said projectile at which said beams are transmitted by and received by said transmitter and receiver units respectively to achieve a comparatively large angle between the outer rays in the transmitter and received beams respectively and to maximize the measuring base defined between said transmitted and received beams of radiation, said transmitter unit comprising a pyrotechnical charge positioned at the extreme rear of said projectile, an opening in the side of said projectile connected via an interior channel to the space containing said charge, said pyrotechnical charge, when ignited, being operative to cause emission of light via said channel and opening, and a lens adjacent said opening for forming said emitted light into said transmitted beam, said opening being provided with a protective cover overlying said lens, said cover being arranged to be removed by the forces generated adjacent thereto when the projectile is fired from a gun barrel.

13. In a projectile of the type comprising an elongated casing containing a payload, a proximity fuze, a transmitter unit operative to transmit a beam of radiation toward a target at an angle to the longitudinal axis of said projectile, and a receiver unit responsive to a received beam of radiation reflected from the target and crossing said transmitted beam for controlling said proximity fuze to selectively initiate operation of said payload at a predetermined distance from the target, the improvement wherein said transmitter unit is located adjacent the tail end of said projectile rearward of said payload, and said receiver unit is located adjacent the nose end of said projectile forward of said payload thereby to widely separate the positions on said projectile at which said beams are transmitted by and received by said transmetter and receiver units respectively to achieve a comparatively large angle between the outer rays in the transmitted and received beams respectively and to maximize the measuring base defined between said transmitted and received beams of radiation, said receiver unit including a substantially ellipsoidal receiving lens located in the tapered envelope surface of said casing, and a flat mirror set at an angle to and co-acting with said lens.

14. The projectile of claim 13 wherein said receiver unit includes a radiation detector, and an interference filter for transmitting energy of a predetermined wavelength range, said filter being located between said mirror and said detector.

15. The projectile of claim 14 wherein said receiver unit includes an electronic control circuit cooperating with said radiation detector, said receiver unit including an internal partition adjacent the nose end of said projectile, said detector, filter, mirror, and lens being located within said receiver unit rearward of said partition, and said electronic control circuit being located within said receiver unit forward of said partition at the forwardmost end of said projectile.

* * * * *